United States Patent [19]

Owens et al.

[11] Patent Number: 4,761,653

[45] Date of Patent: Aug. 2, 1988

[54] MICROSTRIP ANTENNA

[75] Inventors: Roger P. Owens, Wedmore; James Tomlinson, Wells, both of England

[73] Assignee: Thorn Emi Electronics Limited, Hayes, England

[21] Appl. No.: 33,212

[22] Filed: Apr. 2, 1987

[30] Foreign Application Priority Data

Apr. 2, 1986 [GB] United Kingdom ..... 8608013

[51] Int. Cl.[4] ..... H01Q 1/38

[52] U.S. Cl. ..... 343/700 MS; 343/705

[58] Field of Search ..... 343/700 MS, 705

[56] References Cited

U.S. PATENT DOCUMENTS 4,450,449 5/1984 Jewitt ..... 343/700 MS 4,464,663 8/1984 Lalezari et al. ..... 343/700 MS

FOREIGN PATENT DOCUMENTS 0007707 1/1982 Japan ..... 343/700 MS

OTHER PUBLICATIONS

"Broadband Circularly Polarised Planar Array Composed of a Pair of Dielectric Resonator Antennas", Haneishi and Takazawa, *Electronics Letters, vol. 21, No. 10, May 9, 1985, pp. 437–438.*

*Primary Examiner*—William L. Sikes

*Assistant Examiner*—Doris J. Johnson

*Attorney, Agent, or Firm*—Fleit, Jacobson, Cohn & Price

[57] ABSTRACT

A microstrip antenna is formed of a 3×2 group of elements, with adjacent H-feeds. The outer pairs of elements are responsive to opposite senses of polarisation respectively and the inner pair of elements is responsive to both sense of polarisation. The appropriate phase for the respective element orientations are obtained by making $S=r+\lambda/4$ and $q=p+\lambda/2$ where $\lambda$ is the wavelength of radiation. The element spacing lies between $0.5\lambda$ and $1.0\lambda$, typically $0.85\lambda$.

Larger arrays are formed both by increasing the number of pairs of elements responsive to both senses of polarisation, but leaving the two outer pairs responsive only to respective opposite senses of polarisation, and by increasing the number of rows of pairs.

4 Claims, 1 Drawing Sheet

MICROSTRIP ANTENNA

Figure 1:
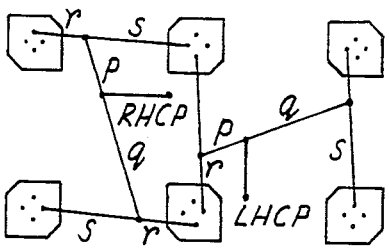

This invention relates to microstrip antenna arrangements.

A known microstrip antenna element for radiating or receiving circularly polarised radiation comprises a square conducting element with two opposite corners bevelled. It has two feed points appropriate for left-hand circular polarisation (LHCP) and two feed points appropriate for right-hand circular polarisation (RHCP). Haneishi and Takazawa have proposed, in Electronics Letters, Vol. 21, No. 10, 9th May 1985, pp. 437–8, a 4×4 element RHCP sub-array, formed by four 2×2 element sub-groups on a ground plane; each sub-group is formed of four elements, each arranged such as to be rotated by 90° with respect to its neighbours in the sub-group. The elements in each 2×2 sub-group are connected via H-feeds linked in pairs to the input/output terminal of the 4×4 element sub-array. The H-feed connections are off-centre to give the correct phasing for the respective element orientations. This array has the disadvantage that its use is limited to one sense of circular polarisation determined by the feed points used at the elements.

One form of microstrip antenna array suitable for use with two orthogonal linear polarisations is described in U.S. Pat. No. 4,464,663. It comprises a linear array of pairs of square microstrip antenna elements, each connected to two feeds so that one feed renders each element responsive to one of two orthogonal linear polarisations and the other feed renders each element responsive to the other of the two orthogonal linear polarisations. In this way, the connections between the two input/output ports and the four associated elements render each of these four elements responsive to respective orthogonal linear polarisations. The element pairs are operated back-to-back by a feed and the necessary 180° phase correction is provided by the asymmetrical connection. In this way, the isolation between the two polarisation feeds is enhanced. This antenna array is narrow-band and both orthogonal linear polarisations operate at the same frequency.

One object of the present invention is to provide a two-dimensional microstrip antenna array arrangement which can be used for both senses of circular polarisation simultaneously and independently, thus allowing simultaneous transmission and reception.

A further object of the present invention is to provide a two-dimensional broad-band dual circular polarisation microstrip antenna array arrangement, enabling different frequencies to be used for the two senses of circular polarisation.

A still further object of the present invention is to provide a two-dimensional dual circular polarisation microstrip antenna array with a simplified feed arrangement.

The present invention provides a microstrip antenna comprising: a plurality of microstrip antenna radiation elements arranged in a lattice formation; first means to feed signals to and/or from a first sub-array of at least some of the elements of the lattice formation, the first feed means being connected to these elements of the first sub-assembly to effect circular polarisation in one sense; second means to feed signals to and/or from a second sub-array of at least some of the elements of the lattice formation, the second feed means being connected to these elements of the second assembly to effect circular polarisation in the other sense; at least some of the elements of the lattice formation being common to both the first sub-array and the second sub-array.

Preferably, some of said elements around the perimeter of said array lie within said first sub-array only, others of said elements around said perimeter lie within said second sub-array only, and the remainder of said elements in said array are common to both said first and said second sub-arrays.

In a preferred embodiment, the array is rectangular and comprises $(2n_1+1)\times 2n_2$ elements where $n_1$ and $n_2$ are integers. The $2n_2$ elements at one edge of the array are used for one sense of circular polarisation only and the $2n_2$ elements at the opposite edge of the array are used for the other sense of polarisation only, the remaining elements being used for both senses of circular polarisation. Thus, two overlapping $2n_1\times 2n_2$ sub-arrays, one for each sense of polarisation, are formed by adding an extra $2n_2$ elements and providing a second feed arrangement. For example, a 13×12 element array provides two almost completely overlapping 12×12 element sub-arrays, one for each sense of circular polarisation. This arrangement simplifies the feed connections.

Figure 2:
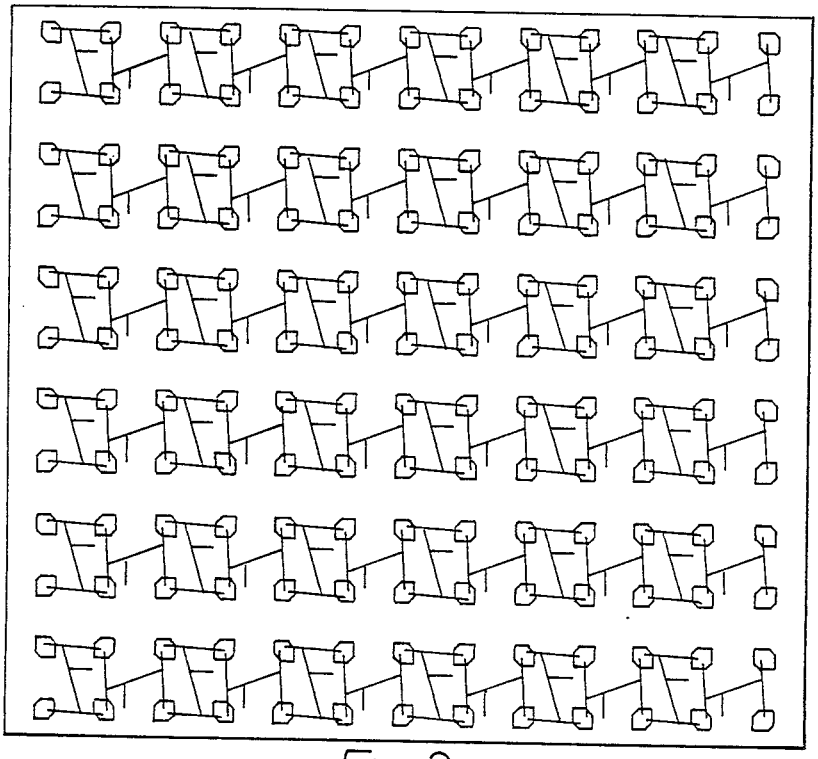
Figure 3:
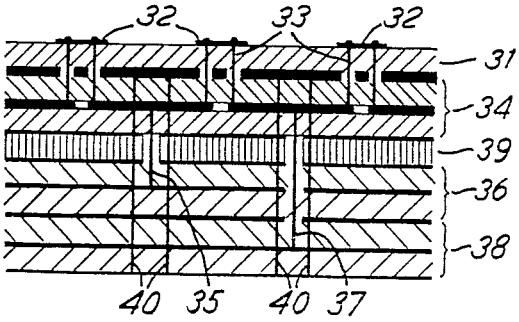

The invention will now be described in greater detail with reference to the accompanying drawings of which:

FIG. 1 shows a 3×2 group of elements with H-feeds for both senses of circular polarisation, in accordance with the invention, FIG. 2 shows a 13×12 element array with interlaced H-feeds, in accordance with the invention, FIG. 3 shows part of the cross-section of the antenna array of FIG. 1.

The preferred form of dual feed is shown in FIG. 1 for a 3×2 group of elements, the RHCP & LHCP H-feeds being adjacent rather than overlapping. The correct phase for the respective element orientations are obtained by making $S=r+\lambda/4$ and $q=p+\lambda/2$ where $\lambda$ is the wavelength of radiation. The element spacing lies between $0.5\lambda$ and $1.0\lambda$, typically $0.85\lambda$. In this sub-group, the outer pairs of elements are responsive to opposite senses of polarisation respectively and the inner pair of elements is responsive to both senses of polarisation. Larger arrays are formed both by increasing the number of pairs of elements responsive to both senses of polarisation, but leaving the two outer pairs responsive only to respective opposite senses of polarisation, and by increasing the number of rows of pairs. A 13×12 element array formed in this way is shown in FIG. 2. In this arrangement the LHCP and RHCP sets of H-feeds are interlaced, enabling both sets to be printed on a single circuit layer. Access to the H-feeds is by probes to the appropriate feed networks from lower circuit layers. If the two sets of H-feeds to the elements were overlapped rather than interlaced (that is H-feeds for both senses of circular polarisation being applied to the same groups of four elements), a 12×12 array could be used, but the two sets of H-feeds would have to be printed on separate circuit layers.

An example of the cross-section of the antenna array of FIG. 2 is given in FIG. 3. The top layer 31 is the microstrip layer of RT/duroid on which the radiating elements 32 are formed. These elements are connected by means of probes 33 to the triplate 34 also of RT/duroid on which LHCP and RHCP H-feeds for the four-element groups are printed. The H-feeds for one sense of circular polarisation are connected by probes 35 to a second feed network printed on the triplate 36 and the H-feeds for the other sense of circular polarisation are connected by probes 37 to a third feed network printed on the triplate 38. The lower triplates 36 and 38 comprise low density foam and copper-clad film in order to keep the weight of the antenna down. There is an aluminium support layer between the two triplate layers 34 and 36. Mode-suppressing pins 40 are inserted into the structure. Input/output connections are made using SMA edge connectors. Side-lobes in the antenna response pattern can be suppressed by arranging the power distribution among the elements to be Dolph-Chebysher or Taylor one or two parameter distributions.

The above description is by way of example only. Other forms of microstrip element capable of being rendered responsive to both senses of circular polarisation would be suitable. For a narrow-band arrangement, all the bevelled elements of FIG. 2 would be oriented either identically, with $p=q$ and $r=s$ in FIG. 1, or alternately at 180°, with $p=q$ and $s=r+\lambda/2$, or with alternate rows or columns at 180°, appropriate $\lambda/2$ phase adjustments being made in the connections.

We claim:

1. A microstrip antenna comprising: a plurality of microstrip antenna radiation elements arranged in a lattice formation; first means to feed signals to or from a first sub-array of elements of the lattice formation, the first feed means being connected to elements of the first sub-array to effect circular polarisation in one sense; second means to feed signals to or from a second sub-array of elements of the lattice formation, the second feed means being connected to elements of the second assembly to effect circular polarisation in the other sense; elements of the lattice formation being common to both the first sub-array and the second sub-array; first feed points for the common elements in relation to circular polarisation in said one sense; and second feed points for the common elements in relation to circular polarisation in said other sense; each common element having associated therewith a first feed point and a second feed point.

2. An antenna according to claim 1, wherein a first set of said elements around the perimeter of said array lie within said first sub-array only, a second set of said elements around said perimeter lie within said second sub-array only, and the remainder of said elements in said array are common to both said first and said second sub-arrays.

3. An antenna according to claim 1, wherein the array is rectangular and comprises $(2n_1+1)\times 2n_2$ elements where $n_1$ and $n_2$ are integers.

4. An antenna according to claim 1, wherein $2n_2$ elements at one edge of the array are used for one sense of circular polarisation only and the $2n_2$ elements at the opposite edge of the array are used for the other sense of polarisation only, the remaining elements being used for both senses of circular polarisation.

* * * * *